United States Patent [19]

Arnal et al.

[11] 4,137,594

[45] Feb. 6, 1979

[54] ROTARY CLEANING BRUSHES

[76] Inventors: Claude Arnal; François Fidry, both of 6 Rue Pelleport, Paris 75020, France

[21] Appl. No.: 781,749

[22] Filed: Mar. 28, 1977

[51] Int. Cl.[2] ..... A46B 1/00

[52] U.S. Cl. ..... 15/198; 15/21 D; 15/181; 15/DIG. 3

[58] Field of Search ..... 15/21 D, 21 E, 179, 15/181, 193, 198, 195, DIG. 3; 300/21; 51/400

[56] References Cited

U.S. PATENT DOCUMENTS

| | | | |
|---|---|---|---|
| 2,648,084 | 8/1953 | Swart | 15/198 |
| 2,929,086 | 3/1960 | Peterson | 15/181 |
| 3,142,081 | 7/1964 | Hartz et al. | 15/193 X |

*Primary Examiner*—Edward L. Roberts
*Attorney, Agent, or Firm*—Gottlieb, Rackman & Reisman

[57] ABSTRACT

The invention relates substantially to brush consisting of a number of wire bundles forming knots and extending radially from the periphery of a heat conducting disc supporting the wire bundles, all being covered by a first layer of elastomer which has attached to it a second layer of elastomer of substantially less diameter, extending over a portion of said knots; the remainder of the knobs being left uncovered by the second layer thereby forming a flexible base for the movement of the knots as well as permitting heat conduction to the air.

5 Claims, 6 Drawing Figures

ROTARY CLEANING BRUSHES

One of the objects of the invention is to provide effective cleaning by a multi-filament rotary brush without excessively heating the filaments of the brush, which in turn by becoming soft due to excessive heating will impair the effective cleaning of the surface to be brushed.

Another object of the invention is to embed the filaments in an elastomer permitting substantially elastic flexibility of the filaments usually of relatively high breaking strength, when brushing against a surface to be cleaned while at the same time preventing a permanent deformation or breakage, simultaneously also assuring sufficient heat conduction from the filament through the embedding to the outside, thereby reducing the risk of excessive heating of the filaments.

Still another object of the invention is to control the temperature of the brush by varying speed and/or pressure under control of heat radiated from the brush.

A specific object of the invention is to arrange the filaments formed in knots of bundles of wire, along the periphery of a supporting disc, in layers of elastomer arranged on one or both sides of the supporting disc, one elastomer bottom layer covering the entire brush including disc and adjoining filament knots radially extending beyond the periphery of the disc, and another elastomer layer superimposed on the first layer but of a substantially smaller diameter than the first layer, extending substantially only to a periphery covering the knots of filaments, from the knots or at least a portion of the knots, without covering the ends extending from the knots.

In a modification of the invention, each wire bundle is formed in a number or sequence of knots, with the second elastomer layer covering a portion of said knots.

A further object of the invention is to increase heat conduction by treating the surface of the filament, or by providing a layer on the filament surface, or by both, to increase conductivity towards the embedding and by further providing in the embedding additional means to increase adherence of the embedding to the filament, thereby increasing heat conduction from the filaments to the outside, and avoiding excessive heating.

These and other objects of the invention will be more fully apparent from the drawings annexed hereto in which FIGS. 1 and 2, the first in cross-section and the second in top view, illustrates a rotary brush according to the invention.

FIG. 3 explains an example for increasing the adherence between a layer of the filaments and a material in the embedding;

Figure 1:
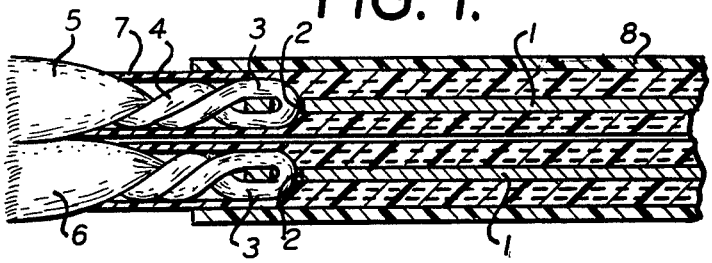
Figure 2:
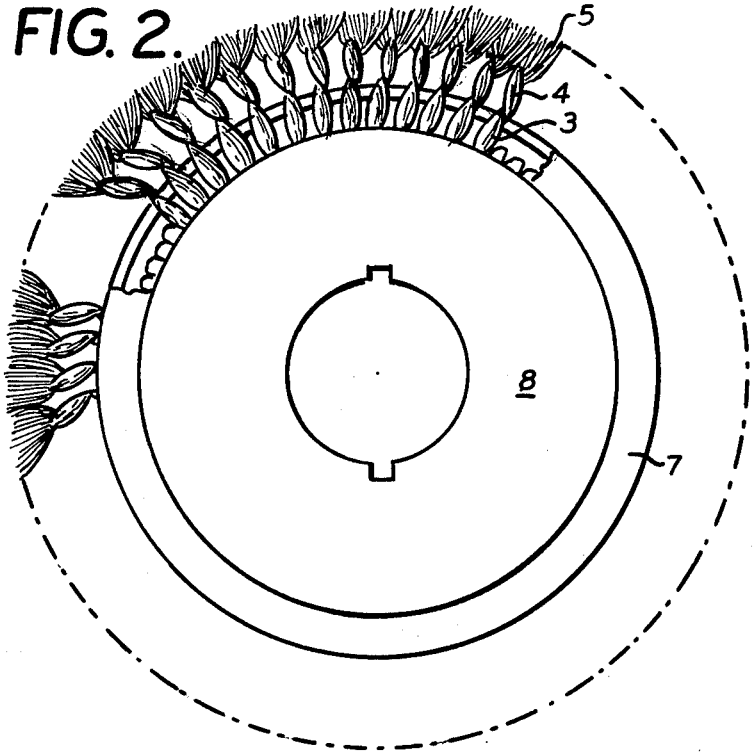

As apparent from FIGS. 1 and 2, a supporting disc 1 made of aluminum or other heat conducting material, is provided with a number of peripheral holes 2, each supporting a wire bundle 3 forming a knot 4 radially projecting from the periphery of disc 1, with the ends of each bundle projecting from the knot expanding as schematically indicated at 5 and 6.

Each side of disc 1 including knots 4 and ends 5, 6 extending therefrom is covered by an elastomer layer of synthetic rubber 7 applied under heat and pressure as otherwise well known in the art, so as to fill the voids between the knots but also any voids existing between the filaments of the wire bundle, especially in its expanding end portions 5 and 6, respectively, so as to increase elastic flexibility while damping vibrations which would increase heating of the filaments.

However, in accordance with the invention, as a further stiffening of the support of the wire bundles, without noticeably decreasing heat conduction, an additional elastomer layer 8 is applied to first layer 7, extending radially only over a portion of layer 7, covering substantially the knots 4 only, or only a portion of each knot, thereby providing the necessary stiffness to the disc structure supporting the filament bundles, without substantially reducing its conduction of heat emerging especially from the brushing end portions 5, 6 and the knots 4 themselves.

As a specific advantage of this arrangement, the entrance of the elastomer in the expanding end portions 5, 6 of each wire bundle 3, permits an increased damping of the vibrations of the individual wires or filaments, in direct contact with the working surface, and thereby subject to friction heat, therefore requiring heat conduction to an extraordinary extent, which is provided in accordance with the invention through the cascading of elastomer layers of predetermined and different diameters.

In order further to increase heat conduction, especially in the sensitive and active end portions of the wire bundles, the adherence contact between the surface of the individual filaments and the embedding elastomer is increased by providing on the individual filaments a heat conducting layer cooperating with heat conducting elements in the elastomer embedding.

Figure 3:
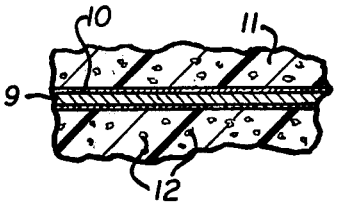

This is illustrated in FIG. 3 where a filament 9, consisting of steel of high breaking strength—in fact the invention permits the use of steel of extraordinary breaking strength such as 350kg/mm @ —whereby the steel wire may be crimped or not,—is coated or electroplated with an aluminum layer, schematically indicated at 10 which in turn is covered by the elastomer 11 in the form of a surface layer such as indicated in FIGS. 1 and 2 at 7. In order to increase adherence and thereby furthering heat conduction, elastomer 11 contains aluminum or aluminum oxide powder or diamond powder as indicated in FIG. 3 at 12.

As apparent from FIGS. 1 and 2, in case several disc assemblies are arranged side by side to operate simultaneously on a working surface, only the outer or end disc assemblies may be provided with an outer elastomer layer of reduced diameter.

Figure 4:
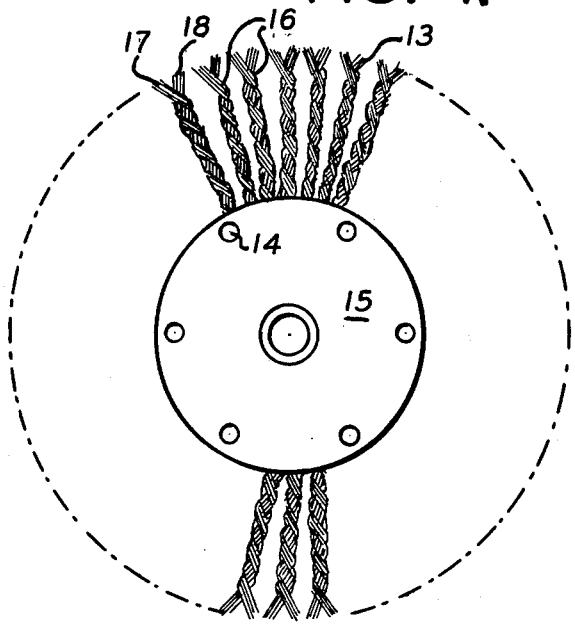
FIG. 4 shows a modification of the invention, including the cascading of a number of knots formed through one wire bundle, and FIG. 5 the top view of a completed wire disc.

In another modification of the invention as exemplified in FIG. 4 in its unimpregnated state, each wire bundle 13 extending through a hole 14, in a supporting disc 15, is formed into a series of knots extending radially from the supporting disc as schematically indicated at 16, with end portions 17 and 18, extending therefrom, but less expanding than the end portions shown in FIGS. 1 and 2 at 5 and 6, respectively.

In this case, the additional top layer of elastomer material, in accordance with the invention, extends over several knots, preferably about half of the knots contained in each wire bundle.

Figure 5:
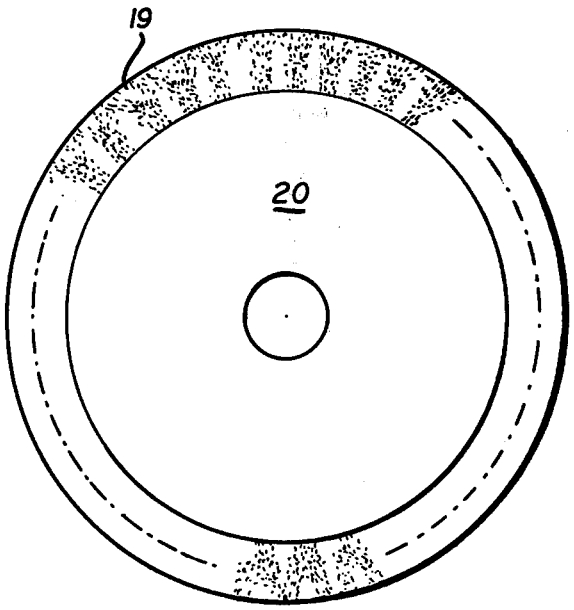

This is illustrated in FIG. 5 which shows a completely impregnated disc 19, with a top layer of reduced diameter as indicated at 20.

In order further to reduce the overheating of the wire disc or discs the speed and/or pressure of the wire disc or discs may be controlled under control of the heat emerging from the disc or discs.

Figure 6:
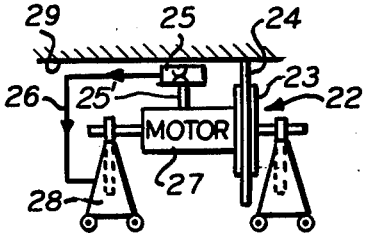
FIG. 6 illustrates a preferred arrangement for controlling speed and/or pressure under control of heat radiated from the brush.

This control is exemplified in FIG. 6, where a wire disc provided with a reduced outer layer 23 is arranged in operation, facing with a relatively exposed portion 24, a photoelectric or heat sensitive cell schematically indicated at 25 which when receiving the heat emanating from brush portion 24, converts it into electrical current, which—if necessary after proper amplification—is applied over line 26 to a servo motor schematically indicated at 27 supporting cell 25 through bracket 25' which in turn is arranged to be driven by hydraulic motor 28, to move disc 2 upward or downward, or more or less closely to the working surface 28, thereby increasing or reducing friction heat, and similarly reducing and increasing the working heat of the disc wires. In this way excessive heating, and thereby damage, of the wire disc can be avoided. Similarly the speed of motor 27 may be controlled. However, neither the control from element 25, of hydraulic motor 28, nor the control of motor 27, nor the structure of these elements, all being known in the art of temperature control, are claimed herein.

While the invention has been described and illustrated by way of specific elements, or arrangements of such elements, it is not limited to any specific structure but may be applied in any way whatsoever, without departing from the scope of this disclosure.

We claim:

1. In combination, a heat conducting disc, having a number of openings arranged along its periphery, and through each of said openings extending radially from said disc, a bundle of wires forming at least one knot for a predetermined distance extending beyond said periphery radially therefrom, the wire bundles having ends extending from said knot for a predetermined distance thereby opening up and forming a substantially cylindrical surface serving as a rotary brushing surface, a first layer of elastomer attached to said disc and extending to cover all the knots formed along its periphery as well as all wire ends extending from said knots in an expanding fashion; and a second layer of elastomer of substantially less diameter than said first layer, attached to said first layer at least on one side thereof, and extending radially over at least said section of the heat conducting disc, from which the wires extend, and further extending leaving exposed to the air a peripheral portion of the first layer and a portion of the adjoining knots; the remainder of the knots being left substantially uncovered by said second layer thereby forming a flexible base for the movement of said knots during the brushing operation as well as permitting heat conduction to the air through said peripheral portion of said first layer.

2. Combination according to claim 1, comprising means between wire and elastomer to increase adherence and thereby heat conduction between wire and eleastomer, including means in the elastomer.

3. Combination according to claim 1, comprising an aluminum layer welded to the wire, and aluminum powder in the elastomer.

4. Combination according to claim 1, comprising heat conducting powder contained in peripheral portions of the elastomer to effect polishing as well as brushing.

5. Combination according to claim 1, wherein the wires are crimped.

* * * * *